US010850752B2

(12) United States Patent
Baker et al.

(10) Patent No.: US 10,850,752 B2
(45) Date of Patent: Dec. 1, 2020

(54) POINT MACHINE AND SWITCH WITH SNAP-ACTION AND METHOD OF OPERATING SAID POINT MACHINE

(71) Applicant: Siemens LTD., Melbourne (AU)

(72) Inventors: Stephen Baker, Mornington (AU); Dion Marriott, Ferntree Gully (AU)

(73) Assignee: Siemens Mobility Pty Ltd., Bayswater (AU)

( * ) Notice: Subject to any disclaimer, the term of this patent is extended or adjusted under 35 U.S.C. 154(b) by 279 days.

(21) Appl. No.: 15/778,695

(22) PCT Filed: Nov. 24, 2015

(86) PCT No.: PCT/US2015/062248

§ 371 (c)(1),
(2) Date: May 24, 2018

(87) PCT Pub. No.: WO2017/091202

PCT Pub. Date: Jun. 1, 2017

(65) Prior Publication Data

US 2018/0346002 A1 Dec. 6, 2018

(51) Int. Cl.
*B61L 5/10* (2006.01)

(52) U.S. Cl.
CPC ..... *B61L 5/107* (2013.01)

(58) Field of Classification Search
CPC .. B61L 5/10; B61L 5/102; B61L 5/105; B61L 5/107
See application file for complete search history.

(56) References Cited

U.S. PATENT DOCUMENTS 6,354,541 B1 * 3/2002 Achleitner ..... B61L 5/10 246/448
6,427,950 B1 * 8/2002 Hoyer ..... B61L 5/04 246/257
6,789,770 B2 * 9/2004 Schnedl ..... B61L 5/04 246/448
7,178,764 B2 * 2/2007 Klein ..... B61L 5/04 246/257
7,674,065 B2 * 3/2010 Schnedl ..... B61L 5/10 403/379.1

(Continued)

FOREIGN PATENT DOCUMENTS

CN 202279135 U 6/2012
CN 104512436 A 4/2015

(Continued)

OTHER PUBLICATIONS

PCT International Search Report and Written Opinion of International Searching Authority dated Oct. 12, 2016 corresponding to PCT International Application No. PCT/US2015/062248 filed Nov. 24, 2015.

*Primary Examiner* — Jason C Smith

(57) ABSTRACT

A switch for a point machine, point machine having said switch, and a method for operating said point machine. The switch opening and closing a circuit providing current to the motor of the point machine. The switch having an elastic element, such as a spring, to create "snap-action" to open and close the circuit. Operation of the motor compressing the spring to open the circuit and cut-off power to the motor when the point machine has completed movement of a point.

17 Claims, 7 Drawing Sheets

(56) References Cited

U.S. PATENT DOCUMENTS

| | | | | |
|---|---|---|---|---|
| 8,684,318 | B2 * | 4/2014 | Chadda | B61L 5/10 246/448 |
| 2004/0135036 | A1 * | 7/2004 | Achleitner | E01B 25/18 246/415 R |
| 2007/0040071 | A1 * | 2/2007 | Oberhoffner | B61L 5/107 246/220 |
| 2008/0179467 | A1 * | 7/2008 | Wagner | B61L 5/107 246/220 |
| 2009/0072097 | A1 * | 3/2009 | Arnold | B61L 5/107 246/220 |
| 2011/0049308 | A1 * | 3/2011 | Beaman | B61L 5/10 246/258 |
| 2013/0264431 | A1 * | 10/2013 | Brushwood | B61L 5/107 246/435 R |
| 2015/0028164 | A1 * | 1/2015 | Mariuzza, Jr. | G01M 99/00 246/253 |
| 2017/0002522 | A1 * | 1/2017 | Arnold | E01B 7/20 |
| 2018/0093682 | A1 * | 4/2018 | McQuistian | B61L 1/025 |
| 2018/0346002 | A1 * | 12/2018 | Baker | B61L 5/107 |
| 2018/0354533 | A1 * | 12/2018 | Palozzi | B61L 5/10 |
| 2019/0061792 | A1 * | 2/2019 | Nagrodsky | G01R 21/08 |

FOREIGN PATENT DOCUMENTS

| | | | | |
|---|---|---|---|---|
| WO | 9854041 | A1 | 12/1998 | |
| WO | 0115955 | A1 | 3/2001 | |
| WO | WO-0115955 | A1 * | 3/2001 | B61L 5/107 |

* cited by examiner

POINT MACHINE AND SWITCH WITH SNAP-ACTION AND METHOD OF OPERATING SAID POINT MACHINE

BACKGROUND

Field

Aspects of the present invention generally relate to a switch with snap-action for a point machine, a point machine with said switch, and method of operating said point machine.

Background

In general, a railroad point (also referred to a turnout) is a mechanical installation at a section of railroad track where the track diverges into two separate tracks: a straight track and a diverging track. The point consists of a set of blades that move laterally between two positions to direct an oncoming train onto either the either the straight or diverging track (for ease of reference, the set of blades will be referred to simply as the "point" hereafter). The operation of a point is well known to one of skill in the art and will not be discussed in greater detail.

The movement of the points is operated by a railroad track point machine (also known as a point motor, switch machine or switch motor). In the past, point machines were purely mechanical, employing hand-thrown levers or rod/wires to operate the point machine at a distance. Over the years, improvements in rail infrastructure have necessitated more powerful point machines driven hydraulically or electrically. Modern point machines employ at least one electrical motor to move the point between its two positions. The operation of a point machine is well known to one of skill in the art and will not be discussed in greater detail.

Safety is the most important design criteria for point machines. When moving track to divert a fast moving train, the tolerance for error is extremely low and the results of a malfunction can be catastrophic. It is crucial that the point machine executes the movement of the point precisely and reliably. The motor most move the point an exact distance in a desired direction and shut off at the end of travel. It is important to verify that the motor has shut off.

Operation of the motor is controlled by an electrical switch (not to be confused with a railroad switch, which is another term used to describe a point or turnout). Mechanical force (usually from movement generated by the motor) opens the electrical switch, cutting off power to the motor, once the motor has completed movement of the point from a first position to the second position. There are a variety of switches that have been employed for this purpose. However, current switch designs are complex and prone to failure through contamination, wear from mechanical stress and vibrational forces.

A significant design need exists for a switch design with the following properties: snap-action to reduce arcing between contacts; detectable switch toggle position, positive override to ensure contact break; and contact wiping ability. It is desirable for these features to fit into the footprint of current switch designs, alleviating the need to alter the internal arrangement of the point machine. The present invention meets all of these functional and design criteria.

SUMMARY

The present invention is directed to an electric switch for a point machine, a point machine with said switch, and a method of operating said point machine. In accordance with one illustrative embodiment, the present invention is an electrical switch with an elastic element, preferably integral to the switch, disposed within the housing for toggling the switch open and closed to regulate current flow to the motor of a point machine.

In accordance with another embodiment, the invention is a point machine with a switch having a deformable elastic element. The point machine comprises a toggle assembly that can translate movement of the point induced by the motor to the switch. Specifically, the toggle assembly acts upon the switch to deform the elastic element and cause the switch to "snap" open, to reducing the likelihood of arcing when the circuit opens.

In accordance with another embodiment, the invention is a method of operating a point machine. The method comprises activating a motor to move a point, the movement of the point translated to a switch by a toggle assembly. The toggle assembly acting on the switch to deform an elastic element within the switch, causing the switch to snap open and cut off power to the motor substantially simultaneously to the point completing its movement.

DETAILED DESCRIPTION

To facilitate an understanding of embodiments, principles, and features of the present invention, they are explained hereinafter with reference to implementation in illustrative embodiments. In particular, they are described in the context of being a switch for a point machine, a point machine system with said switch, and a method of operating a said point machine, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Figure 1:
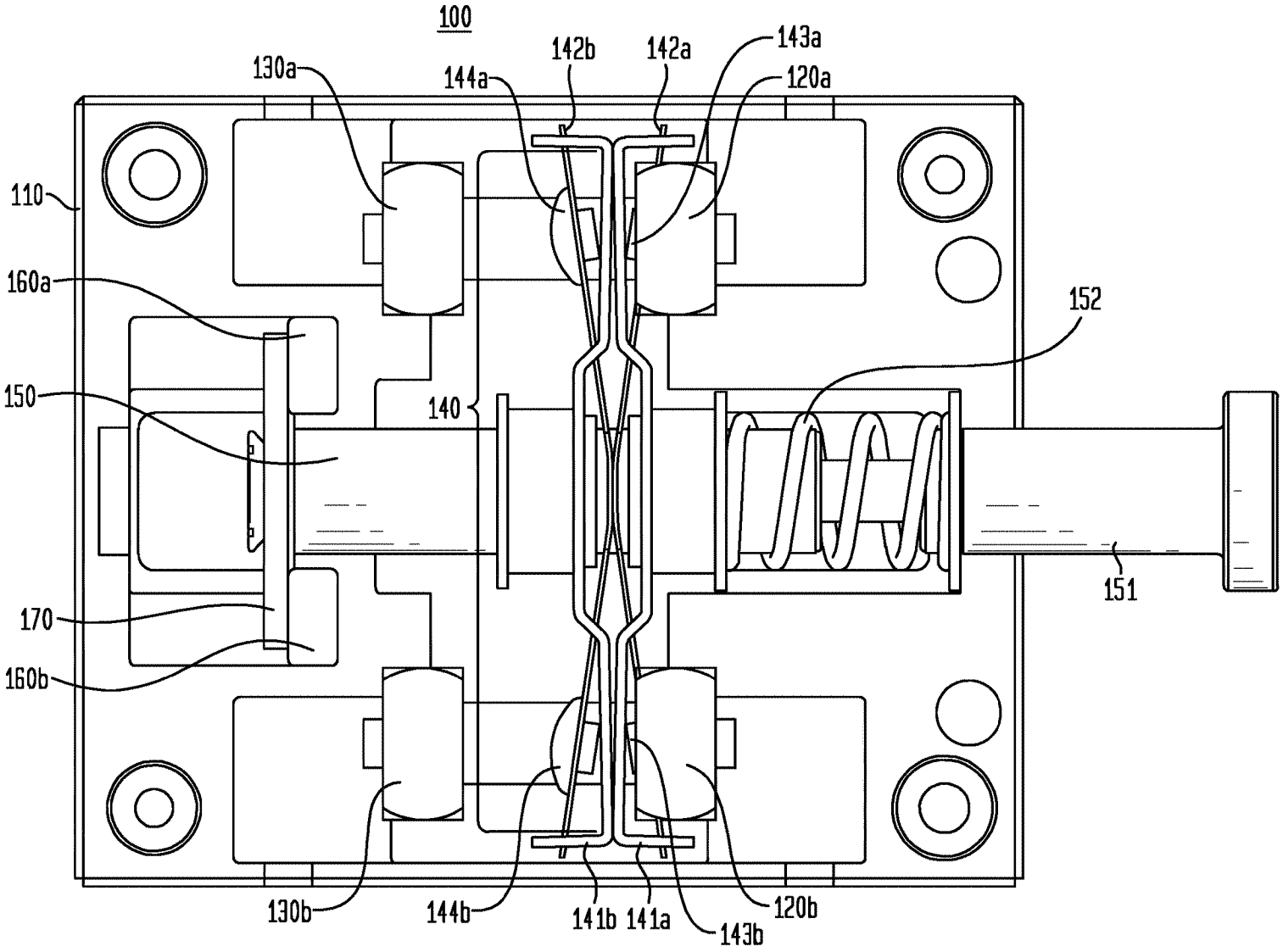
FIG. 1 illustrates an exemplary embodiment of the switch in the closed position.

FIG. 1 illustrates an exemplary embodiment of the switch 100 in the closed position. The switch 100 comprises a housing 110, which preferably has a design footprint similar to existing switches and can be retrofit or incorporated into new units without significant design change to the point machine. The switch 100 is preferably disposed inside of the point machine (not pictured), but in other embodiments may be installed outside the main point machine housing.

In accordance with a preferred embodiment, the housing 110 has two sets of fixed contacts. Motor contacts 120*a* and

120*b* are in electrical communication and forming a circuit with the power supply and motor (both not pictured) of the point machine. When the switch 100 is in the closed position (described in more detail below) current flows between motor contacts 120*a* and 120*b*, closing the circuit with the motor and power supply. This allows current to flow from the power supply to the motor, enabling the motor to operate and the point machine to move the points from a first to a second position. Detection contacts 130*a* and 130*b* are part of a detection circuit, which serves as an indicator whether the switch 100 is toggled closed and the motor is powered or the switch 100 is toggled open, as described in more detail in FIG. 3 below.

In accordance with preferred embodiment, the switch 100 further comprises a moving contact assembly 140, preferably disposed within the housing 110. The assembly 140 comprises a pair of mirroring contact frames 141*a* and 141*b*. The frames 141*a* and 141*b* may carry leaf springs 142*a* and 142*b*, respectively. Springs 142*a* and 142*b* each have a pair of moving contacts 143*a* and *b* and 144*a* and *b* disposed at their distal ends, respectively. In accordance with an exemplary embodiment, the moving contacts 143*a* and *b* and 144*a* and *b* are made of beryllium cooper. Additionally, in accordance with an exemplary embodiment, the moving contacts 143*a* and *b* and 144*a* and *b* all have rounded "wiping" surfaces. As the moving contacts 143*a* and *b* and 144*a* and *b* come into contact with fixed contacts 120*a* and *b* and 130*a* and *b*, respectively, springs 142*a* and *b* are deformed/bent allowing the surfaces of moving contacts 143*a* and *b* and 144*a* and *b* to pivot against the surface of fixed contacts 120*a* and *b* and 130*a* and *b*, this movement effectively cleaning or "wiping" residue or contaminants off the surface that could impede current flow.

In accordance with a preferred embodiment, the moving contact assembly 140 is mounted on cylinder 150. The cylinder 150 is mounted within the housing 110 such that the cylinder 150 can axially, bi-directionally translate a predetermined travel distance. Axial movement of the cylinder 150 carries the moving contact assembly 140 back and forth between the fixed contacts 120*a* and *b* and 130*a* and *b*, opening and closing the circuits as it moves, thereby toggling the switch 100. A piston 151 is also provided, preferably, partially mounted within the house 110 and partially extending outside the housing 110. In accordance with an embodiment of the invention, the piston 151 is coaxially mounted relative to the cylinder 150. In a preferred embodiment, a portion of the piston 151 is disposed within the cylinder 150, allowing the piston 151 to slide axially relative the cylinder 150. In an alternative embodiment, the cylinder 150 could be disposed partially within the piston 151. Other mounting arrangements allowing the cylinder 150 and piston 151 to move relative to each other are also contemplated. A spring 152 can be mounted such that movement of the piston 151 relative to the cylinder 150 causes to the spring 152 to deform. The spring 152 is illustrated as a conventional coil spring. However, it is contemplated that a different type spring or other elastic element having appropriate elasticity could be used. The terms elastic element and spring may be used interchangeably within this specification, but term elastic element contemplates a broader range of elements capable of being deformed. A spring is just a preferred embodiment of an elastic element.

In accordance with a preferred embodiment, a pair of magnets 160*a* and *b* are mounted within the housing 110. The magnets 160*a* and *b* are preferably permanent magnets, but electromagnets are contemplated as well. In alternative embodiments, a single magnet or multiple magnets could be used in place of the two magnets 160*a* and *b* depicted in this embodiment. A ferrous plate 170 is located on the end of the cylinder 150 opposite the piston 151. The magnets 160*a* and *b* exert an attractive magnetic force on the ferrous plate 170. When the plate 170 is "fixed" to the magnets 160*a* and *b*, the cylinder 150 is locked in a fixed position and unable to move within the housing 110 until the connection between the plate 170 and magnets 160*a* and *b* is broken.

Figure 2:
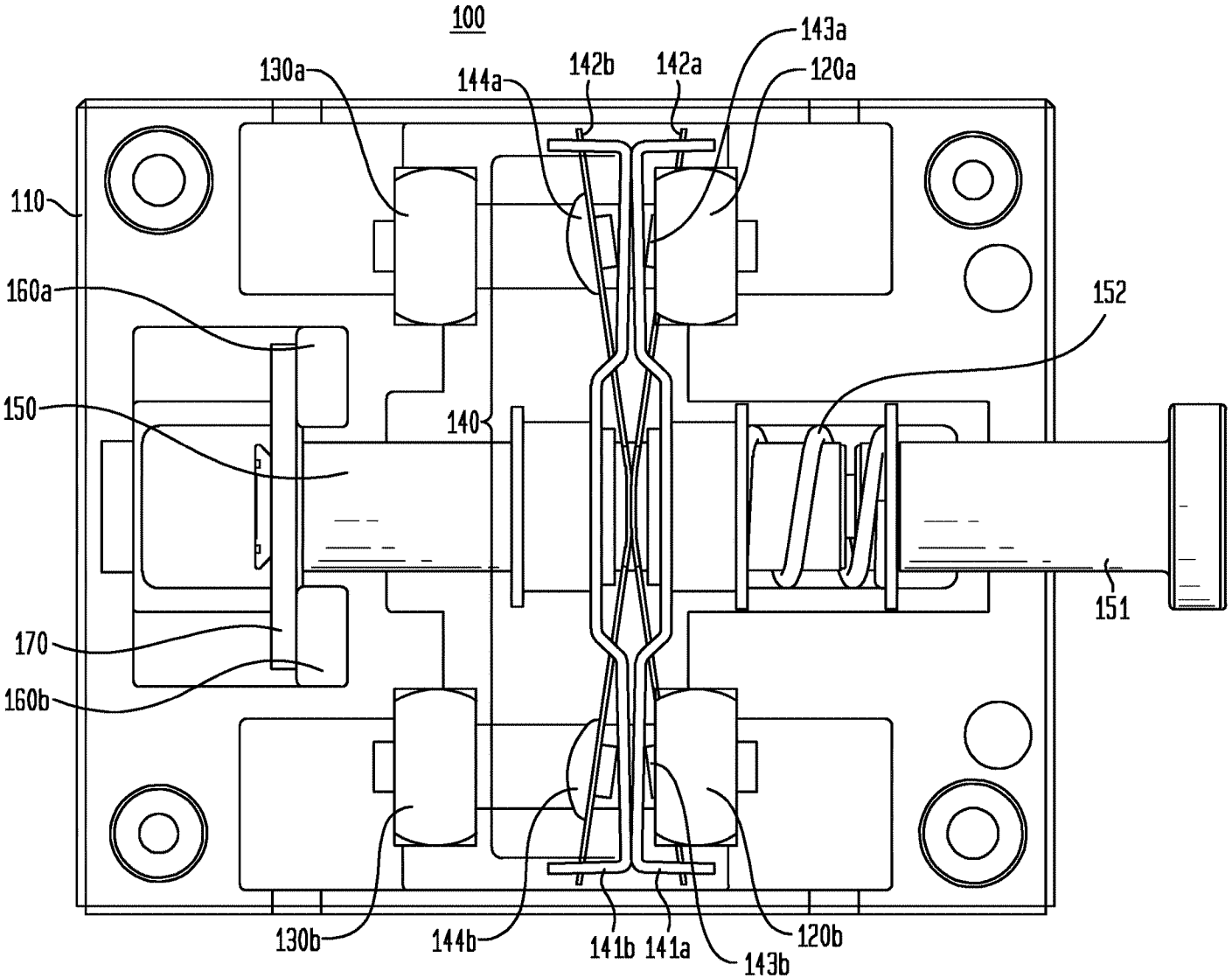
FIG. 2 illustrates an exemplary embodiment of the switch in the closed position with the piston partially depressed.
Figure 3:
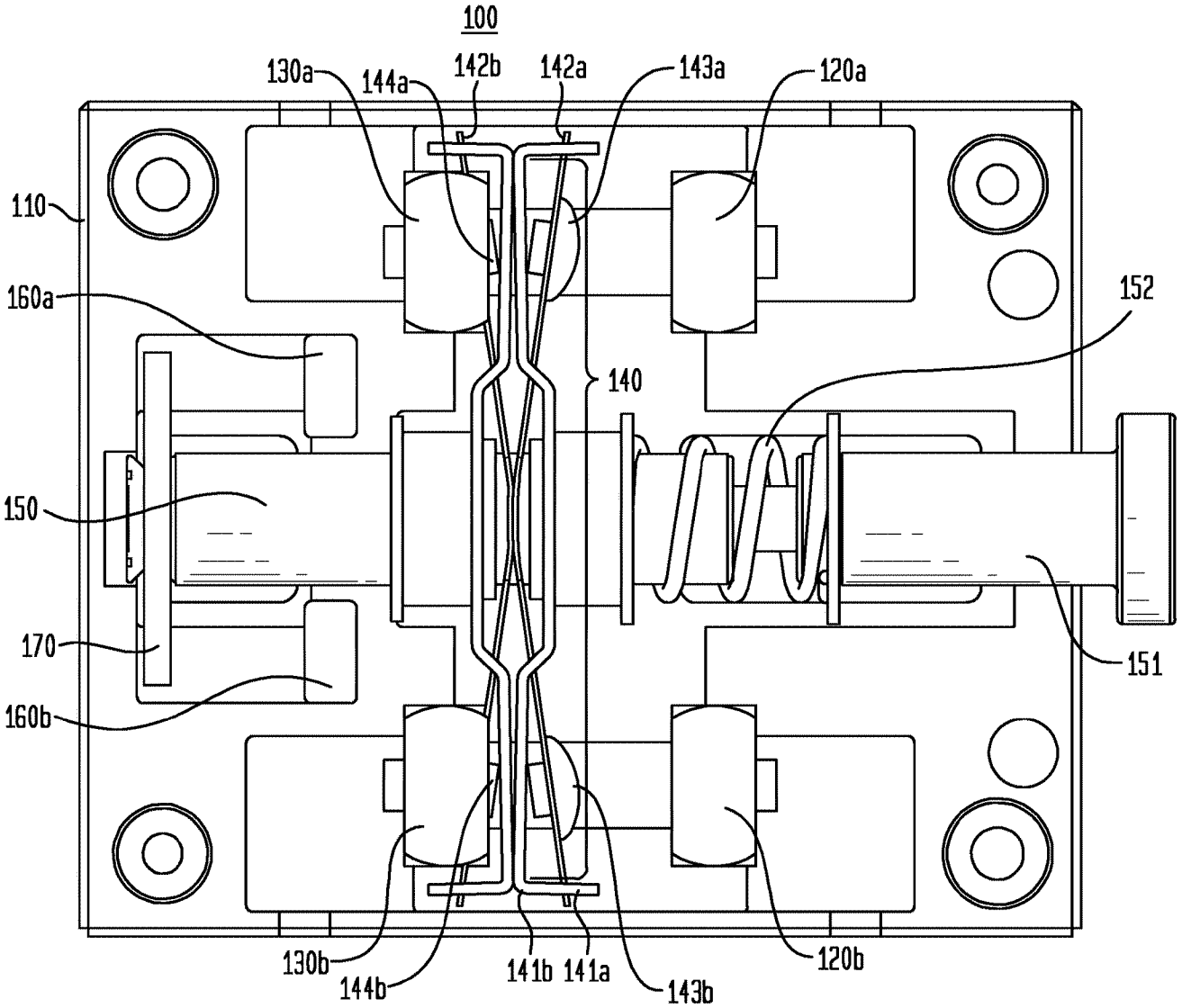
FIG. 3 illustrates an exemplary embodiment of the switch in the open position.

FIG. 1 depicts the switch 100 toggled in closed position. This switch 100 is referred to as being toggled closed because the circuit including the motor and power supply is closed because current can flow between motor contacts 102*a* and *b* through moving contacts 143*a* and *b* and leaf spring 142*a*. The switch 100 is kept locked in the closed position by the magnetic force of magnets 160*a* and *b* exerted on plate 170, which keeps the cylinder 150 in a fixed position such that the assembly 140 is proximate the motor contacts 120*a* and *b* and leaf spring 142*a* is depressed and moving contacts 143*a* and *b* are in physical contact with the motor contacts 120*a* and *b*, respectively, allowing current to flow between said contacts 120*a* and *b* through the moving contacts 143*a* and *b* and spring 142*a*. When the switch 100 is toggled in the closed position, the motor is able to operate and move the point from a first position to a second. FIGS. 2 and 3 illustrate the movement of the switch 100 elements and operation/toggling of the switch 100.

All of the elements in FIG. 2 are identical to FIG. 1. FIG. 2 illustrates the switch 100 still toggled in the closed position, but the piston 151 being translated axially in the direction of the cylinder 150. Movement of the piston 151 is induced by the toggle assembly (not pictured), which is in communication with the motor, as will be discussed in more detail below. The motor moves the point, which move one or more rods, which are connected to a toggle assembly, which toggles the switch by exerting a force on the piston 151, moving it toward the cylinder 150, compressing the spring 152 because the cylinder 150 remains held fixed in place by the force exerted by the magnets 160*a* and *b* on the plate 170. As long as the magnetic force between the magnets 160*a* and *b* and plate 170 is greater than the mechanical force stored in the spring 152, the switch 100 will remain closed and the motor will keep moving the points and further compressing the spring 152. The mechanical force will continue to grow in the spring 152 in accordance with Hooke's Law. In a preferred embodiment of the invention, the spring constant is selected such that the mechanical force in the spring 152 exceeds the magnetic force between the magnets 160*a* and *b* and plate 170 when the motor has fully moved the point from the first position to the second position. When this occurs the stored mechanical energy in the spring 152 is released and "snaps" the cylinder 150 axially in a direction away from the piston 151, thereby opening the switch 100 and cutting off current flow to the motor. It is desired to shut the motor off at this time since the motor has completed moving the point. The "snap-action" caused by the spring 152 reduces potential for arcing between the moving contacts 143*a* and *b* and motor contacts 120*a* and *b*.

The switch 100 includes an integral "fail safe" if the "snap-action" should fail. The most likely point of failure is the spring 152 that generates the "snap-action". If the spring 152 breaks or malfunctions, the piston 151 will continue to toward the cylinder 150. The range of movement of the piston 151 relative to the cylinder 150, however, is limited so that the piston 151 moves relative to the cylinder 150 a predetermined amount after which it pushes the cylinder 150. The range of movement of the piston 151 relative to the cylinder 150 is less than the distance of the movement of the cylinder 150 from the first position to the second position. The range is set so that the piston 151 would push the cylinder 150, overcoming the force of the magnets 160*a* and *b*, opening the switch 100 and shutting off the motor, at the same time as the motor completes movement of the point, thus shutting off the motor.

All of the elements in FIG. 3 are identical to FIGS. 1 and 2. In FIG. 3, the switch 100 has been toggled/"snapped" open due to the movement generated by the motor compressing spring 152 until the stored mechanical energy exceeded the magnetic force between plate 170 and magnets 160*a* and *b*. The spring 152 "snapping" the cylinder 150 in a direction away from the piston 151 also moves the entire assembly 140 away from the motor contacts 120*a* and *b*, preventing current flow between the contacts 120*a* and *b*, opening the circuit with the motor and power supply, shutting off power to the motor and preventing further movement of the point by the motor. The "snap-action" reduces the potential for harmful electric arcing between the contacts. In the open position, the moving contacts 144*a* and *b* are pressed against detection contacts 130*a* and *b*, closing the detection circuit and allowing current to flow between contacts 130*a* and *b* through moving contacts 144*a* and *b* and leaf spring 142*b*. The detection circuit is used to confirm that switch 100 is operating properly, toggled open, and power to the motor has been shut off. If the detection circuit is closed, the motor circuit must be open.

Figure 4A:
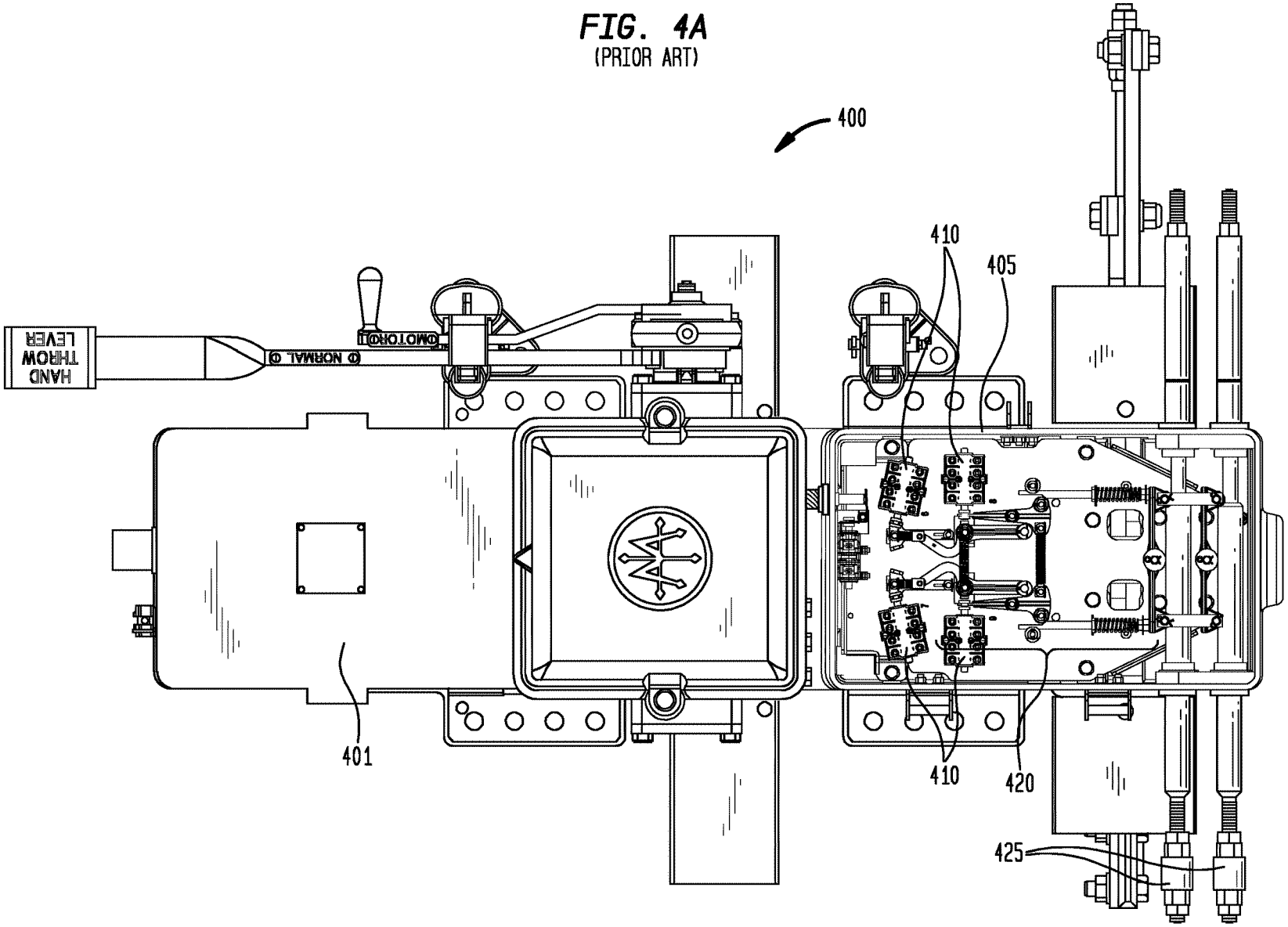
FIG. 4A (PRIOR ART)
FIG. 4A illustrates a point machine with a toggle assembly and switches according to the prior art.

FIG. 4A illustrates a point machine with a toggle assembly and switches according to the prior art. A point machine 400 comprises a motor housing 401. At least one motor (not pictured) for moving the point is disposed within the motor housing 401. A point machine 400 also comprises a toggle assembly housing 405, within which the toggle assembly 420 is housed. The toggle assembly 420 can comprise an arrangement of hinged levers that translate movement of the point, induced by the motor of the point machine, via one or more rods 425, to switches 410. Specifically, the motor moves the point, which is connected to and causes movement of the rods 425, which move the levers of the toggle assembly 420; movement of the levers activates/toggles the switches 410, controlling current flow to the motor. The rods 425 and toggle assembly 420 are calibrated such that the appropriate switch 100 is toggled open to shut off the motor when it completes movement of the point. Switches 410 perform similar basic functions as switch 100 described above in regulating current flow to the motor, but lack the features of switch 100. Among the distinctions between switches 410 and switch 100 is the integral "snap-action" of switch 100 described above. In contrast, the "snap-action" in the prior art is achieved by a spring mechanism in the assembly 420, not in the switch 410 itself.

Figure 4B:
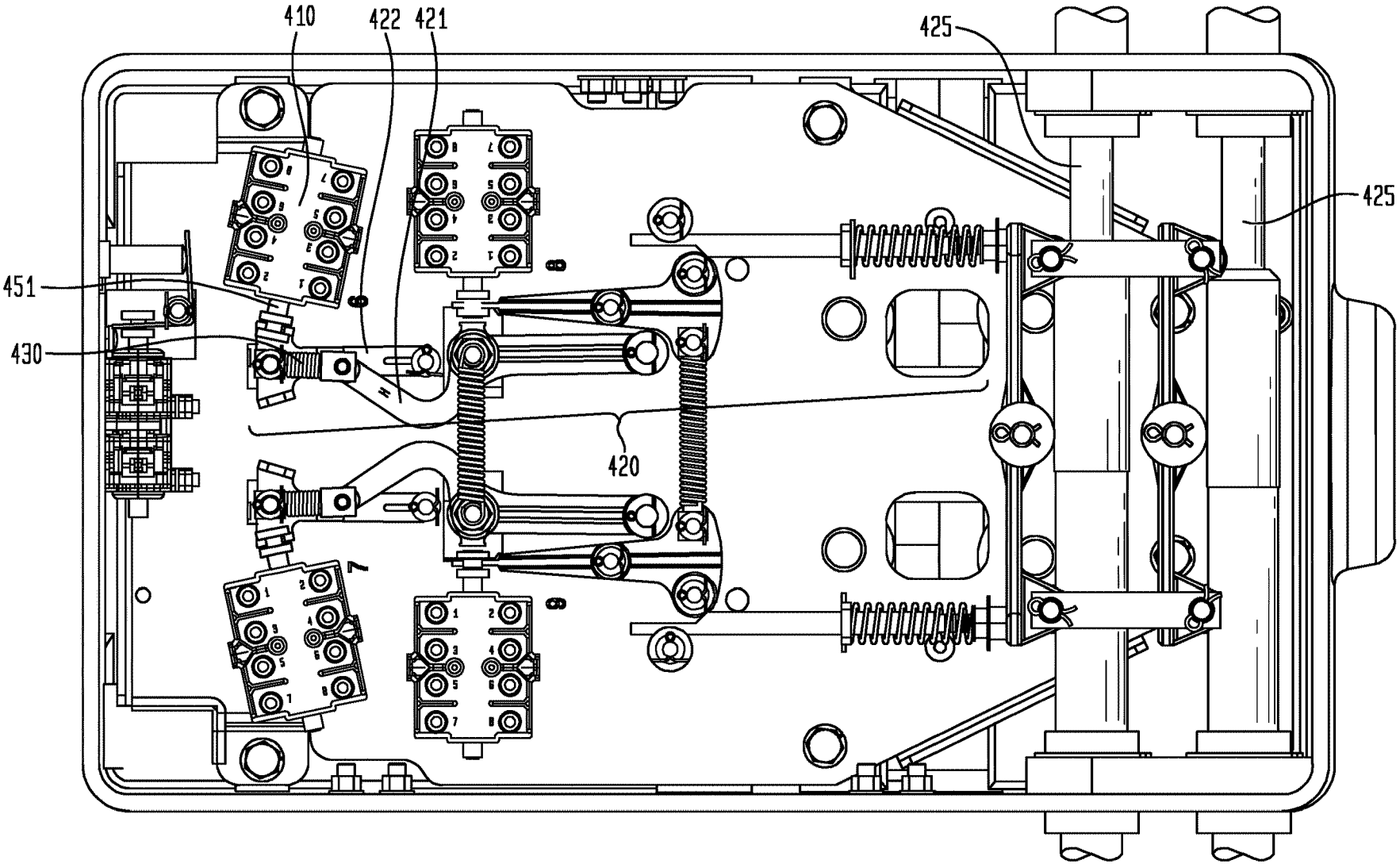
FIG. 4B (PRIOR ART)
FIG. 4B illustrates a close-up of the toggle assemble and a switch according to the prior art.

FIG. 4B illustrates a close-up of the toggle assembly 420 and a switch 410 according to the prior art. The toggle assembly 420 comprises an arrangement of hinged levers that translate movement of the point induced by the motor to the switch 410 as described above. The toggle assembly 420 comprises an intermediary lever 421 that acts upon a toggle lever 422. The toggle lever 422 toggles the switch 410 by pressing against and moving the piston 451. Piston 451 performs a similar function to piston 151. As discussed previously, the switch 410 does not have integral "snap-action" as switch 100 does. Instead, the necessary "snap" to avoid arcing in the contacts is achieved in the prior art by disposing an elastic toggle element 430 between intermediary lever 421 and toggle lever 422. Movement of the intermediary lever 421 deforms the elastic toggle element 430, rather than directly moving the toggle lever 422. When the elastic toggle element 430 has been deformed a predetermined amount, then energy stored within it is released causing the toggle lever 422 to "snap" and push piston 451 to toggle switch 451 into the open position, shutting off power to the motor. This is a more complicated and less reliable arrangement than the operation of the switch 100 described above. It is known to one of ordinary skill in the art that the toggle assembly can operate a plurality of switches 410 and has a mirror arrangement as pictured, although only on "side" is discussed in detail above.

Figure 5:
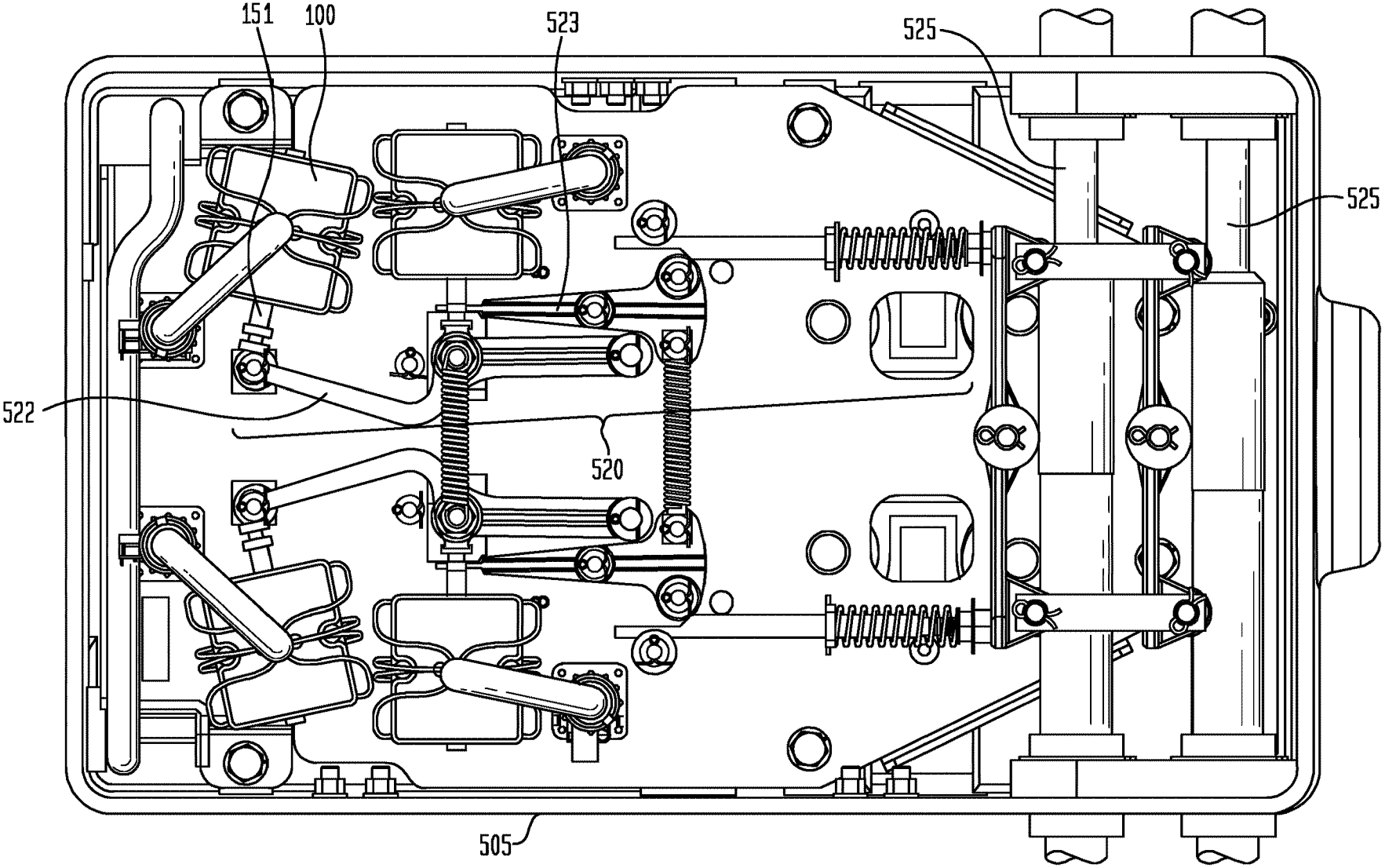
FIG. 5 illustrates an exemplary embodiment of the toggle assembly and switch in a point machine.

FIG. 5 illustrates close-up of the toggle assembly 520 and switch 100 according to a preferred embodiment of the invention. FIG. 5 does not show the entire point machine, the housing, motor, and other not pictured components being substantially similar to those illustrated in FIG. 4A. Switch 100 is the same as described above in FIGS. 1-3. The toggle assembly 520 is disposed within housing 505. Translation of the movement of the point by the motor through rods 525 to the assembly 520 is substantially similar as described above in relation to FIG. 4A. However, the engagement of the switch 100 by the assembly 520 differs from the prior art, because of the "snap-action" integral to switch 100.

Toggle assembly 520 translates movement induced by the motor from rods 525 through the assembly 520 to the piston 151 to toggle switch 100. Specifically, intermediary lever 523 exerts a force directly on toggle lever 522, which presses against piston 151, toggling the switch between first and second (open and closed) positions as described above. It is important to note that no elastic element is interposed between the intermediary lever 523 and toggle lever 522, unlike assemble 420 that utilizes element 430. This is because the point machine of this exemplary embodiment of the invention comprises switch 100 having integral "snap-action", as described above, which simplifies the design of the toggle assembly 520 by removing the need for an elastic element that can generate "snap" toggling.

A comparison of toggle assembly 420 and 520 reveals that assembly 520 does not have components equivalent to toggle lever 422 and elastic toggle element 430, these components being unnecessary since "snap-action" is generated integrally within switch 100. Instead, toggle lever 522 directly interfaces with piston 151 to toggle switch 100, as described above. Toggle assembly 520 is simpler and more reliable than toggle assembly 420 because the design does not require components to generate "snap-action", which require maintenance and are prone to failure.

Figure 6:
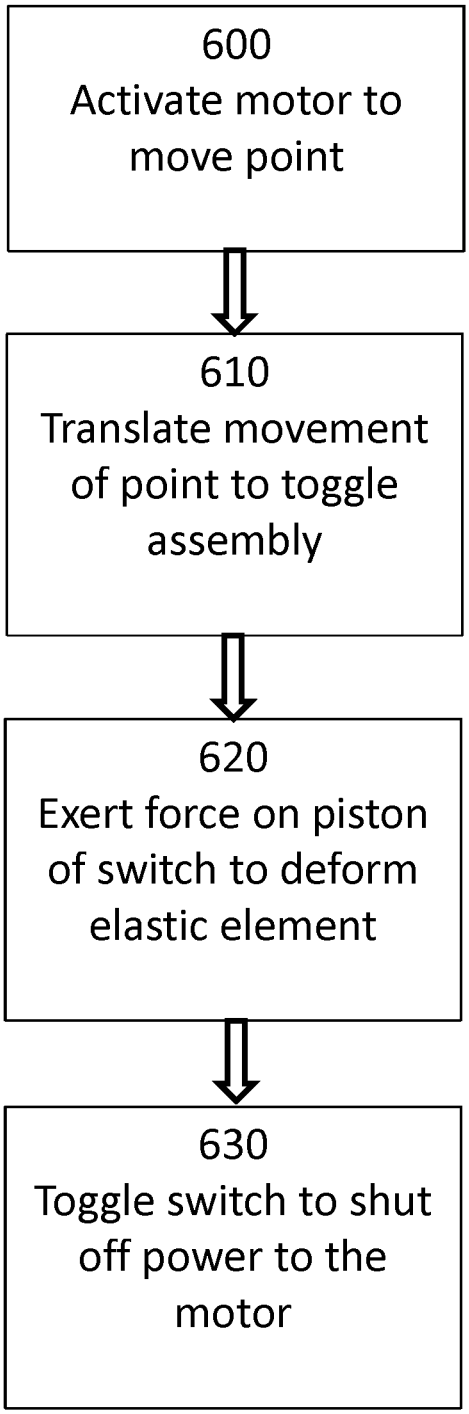
FIG. 6 illustrates a flowchart of a method of operating a point machine.

FIG. 6 is a flowchart of a method of operating a point machine with switch according to an exemplary embodiment of the invention. The switch described in this method is substantially similar to the embodiments of switch 100 and its corresponding components/elements, described above. In step 600, the motor of the point machine is activated to move the point from a first position to a second position. In step 610, the movement of the point is translated to a toggle assembly, preferably via one or more rods, as described in the above embodiments. Preferably, step 600 and 610 occur substantially simultaneously. In step 620, the toggle assembly exerts a force on a piston (or other equivalent element) of the switch to deform an elastic element within the switch. The switch is kept in the toggled closed position by one or more magnets to supply power to the motor. Deformation of the elastic element stores energy in the elastic element. In step 630, when the elastic element is deformed a predetermined amount, the force of the stored energy exceeds the magnetic force keeping the switch closed and the switch is toggled open, shutting off power to the motor. The movement of the toggle assembly, force of the magnet, and the deformation of the elastic element are selected/calibrated such that the switch is toggled open, turning off the motor, when the point completes its movement from the first position to the second.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

Although the steps, operations, or computations may be presented in a specific order, this order may be changed in different embodiments. In some embodiments, to the extent multiple steps are shown as sequential in this specification, some combination of such steps in alternative embodiments may be performed at the same time.

Embodiments described herein can be implemented in the form of control logic in software or hardware or a combination of both. The control logic may be stored in an information storage medium, such as a computer-readable medium, as a plurality of instructions adapted to direct an information processing device to perform a set of steps disclosed in the various embodiments. Based on the disclosure and teachings provided herein, a person of ordinary skill in the art will appreciate other ways and/or methods to implement the invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. An electrical switch for a point machine, the switch comprising:

a housing;

a first motor contact and a second motor contact disposed within the housing, the motor contacts in electrical communication with a motor circuit providing power to an electrical motor of the point machine;

a cylinder disposed within the housing such that the cylinder can move within the housing between a first position and a second position;

a first contact frame attached to the cylinder, the contact frame moving with the cylinder;

a first moving contact and a second moving contact disposed on the first contact frame and moving with the cylinder, the first contact frame and first and second moving contacts providing electrical communication between the first and second motor contacts when the cylinder is in the first position;

a piston partially disposed outside the housing, the piston in communication with the cylinder, the piston capable of moving within the housing relative to the cylinder;

an elastic element in communication with the cylinder and the piston, wherein movement of the piston relative to the cylinder deforms the elastic element;

a magnetic element attached to the housing exerting a magnetic force on the cylinder keeping the cylinder stationary in the first position from moving relative to the housing;

wherein movement of the piston relative to the cylinder exerts a first force on the elastic element deforming the elastic element, the deformation of the elastic element causing the elastic element to exert a second force on the cylinder, the cylinder being able to move from the first position to the second position when the second force exceeds the magnetic force.

2. The electrical switch of claim 1, wherein when cylinder is in the first position the motor circuit is closed and current can flow to the electrical motor.

3. The electrical switch of claim 1, wherein when the cylinder is in the second position the motor circuit is open and current cannot flow to the electrical motor.

4. The electrical switch of claim 1, the first and second moving contacts attached to the first contact frame by a leaf spring, the spring being deformed and pushing the first and second moving contacts against the surface of the motor contacts when the cylinder is in the first position.

5. The electrical switch of claim 4, the first and second moving contacts having a rounded surface, wherein the surfaces of the first and second moving contacts pivot against the surface of the motor contacts as the cylinder moves to or from the first position, thereby wiping contaminants off the surface of the first and second moving contracts and the surface of the motor contacts.

6. The electrical switch of claim 1, the distance the piston can move relative to the cylinder being less than the distance the cylinder moves between the first position and second position.

7. A point machine having the switch of claim 1, the point machine comprising:

a motor in communication with a point;

a toggle assembly in mechanical communication with the point, wherein movement of the point induced by the motor is translated to movement of the toggle assembly, the toggle assembly exerting a force on the piston of the switch.

8. The electrical switch of claim 1, the longitudinal axes of the cylinder and piston being collinear, the cylinder and piston moving within the housing parallel to the longitudinal axes.

9. The electrical switch of claim 1, further comprising:

a first detection contact and a second detection contact disposed within the housing, the detection contacts in electrical communication with a detection circuit;

a second contact frame attached to the cylinder, the second contact frame moving with the cylinder;

a third moving contact and a fourth moving contact disposed on the second contact frame and moving with the cylinder, the second contact frame and third and fourth moving contacts providing electrical communication between the first and second detection contacts when the piston is in the second position, thereby closing a detection circuit, the closed detection circuit being indicative of the motor circuit being open.

10. A point machine comprising:

a motor in mechanical communication with a point;

a motor circuit providing current to the motor from a power supply, wherein when the circuit is closed the motor receives current from the power supply and when circuit is open current cannot flow from the power supply to the motor, a switch in electrical communication with the motor circuit, the switch capable of being toggled between an open and closed position, wherein when the switch is toggled in the open position the motor circuit is open and when the switch is toggled in the closed position the motor circuit is closed, the switch having an elastic element, deformation of the elastic element toggling the switch between open and closed positions;

a toggle assembly, wherein operation of the motor induces movement of the toggle assembly, wherein movement of the toggle assembly deforms the elastic element to toggle the switch to open and close the motor circuit.

11. The point machine of claim 10, the switch having a housing and a piston, the piston partially disposed outside the housing, the piston in mechanical communication with the elastic element whereby movement of the piston deforms the elastic element, the piston in communication with the toggle assembly.

12. The point machine of claim 11, the toggle assembly having an intermediary lever and a toggle lever, wherein the intermediary lever directly exerts a force upon the toggle lever without an elastic element transferring the force from the intermediary lever to the toggle lever.

13. The point machine of claim 12, the toggle lever exerting a force on the piston to move the piston and deform the elastic element, toggling the switch.

14. The point machine of claim 13, wherein when the motor moves the point, at least one rod translates movement of the point to the toggle assembly, wherein movement of the toggle assembly comprises the intermediary lever being moved and exerting a force on the toggle lever to move the toggle lever, movement of the toggle lever exerting a force on the piston which deforms the elastic element, toggling the switch open and shutting off power to the motor at the same time as the motor completes movement of the point.

15. A method for operating a point machine, the method comprising:

activating a motor of the point machine to move a point from a first position to a second position;

translating a movement of the point to movement of a toggle assembly of the point machine;

exerting a force by the movement of the toggle assembly on an element of a switch to deform an elastic element within the switch;

toggling the switch open to shut off power to the motor when the elastic element is deformed a predetermined amount; and keeping the switch closed using a magnetic element within the switch.

16. The method of claim 15, wherein the elastic element is deformed a predetermined amount when the point completes its movement from the first position to the second position.

17. The method of claim 15, wherein the step of toggling the switch open comprises the force stored in the elastic element due to its deformation exceeding the force exerted by the magnetic element.

* * * * *